US008203058B2

(12) United States Patent
Leach

(10) Patent No.: US 8,203,058 B2
(45) Date of Patent: Jun. 19, 2012

(54) FOLDING GUITAR WITH SELF ALIGNING NECK

(75) Inventor: Harvey Leach, Cedar Ridge, CA (US)

(73) Assignee: Voyage-Air Guitar Inc., Livermore, CA (US)

( * ) Notice: Subject to any disclaimer, the term of this patent is extended or adjusted under 35 U.S.C. 154(b) by 385 days.

(21) Appl. No.: 11/958,344

(22) Filed: Dec. 17, 2007

(65) Prior Publication Data

US 2009/0151537 A1 Jun. 18, 2009

(51) Int. Cl.
*G10D 3/00* (2006.01)

(52) U.S. Cl. ..... 84/267; 84/293

(58) Field of Classification Search ..... 84/267
See application file for complete search history.

(56) References Cited

U.S. PATENT DOCUMENTS

| | | | | | |
|---|---|---|---|---|---|
| 1,269,403 | A * | 6/1918 | Dianovszky | ..... | 16/369 |
| 4,172,405 | A * | 10/1979 | Kaman, II | ..... | 84/293 |
| 4,638,708 | A * | 1/1987 | Kamal | ..... | 84/293 |
| 4,780,929 | A * | 11/1988 | Burns et al. | ..... | 16/349 |
| 5,233,896 | A * | 8/1993 | Worthington et al. | ..... | 84/293 |
| 5,383,385 | A * | 1/1995 | Gilbert | ..... | 84/267 |
| 5,390,578 | A * | 2/1995 | Raymer | ..... | 84/291 |
| 6,028,255 | A * | 2/2000 | Myronyk | ..... | 84/293 |
| 6,046,393 | A * | 4/2000 | Rose | ..... | 84/293 |
| 6,353,164 | B1 * | 3/2002 | Corsi | ..... | 84/293 |
| D516,114 | S * | 2/2006 | Leach | ..... | D17/20 |
| 2007/0289427 | A1 * | 12/2007 | Liang | ..... | 84/291 |

* cited by examiner

*Primary Examiner* — Elvin G Enad
*Assistant Examiner* — Christopher Uhlir
(74) *Attorney, Agent, or Firm* — Handal & Morofsky LLC

(57) ABSTRACT

A self aligning folding guitar comprises a neck portion, and a body portion. They hinge it is mounted to the neck portion and the body portion. A first alignment member is secured to the neck portion. The second alignment member is secured to the body portion, the second alignment member meeting with the first alignment member at a substantially fixed position. A securement member secures the first alignment member to the second alignment member.

13 Claims, 12 Drawing Sheets

Figure 1
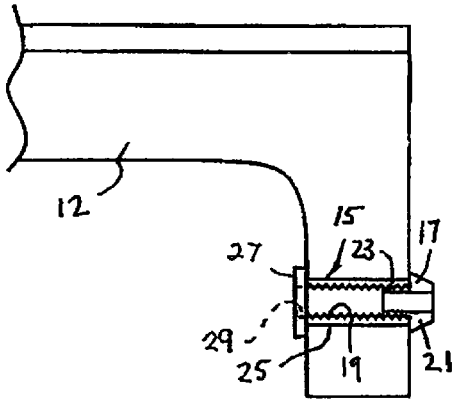
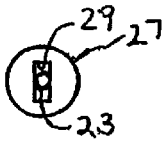
Figure 2
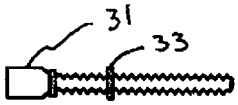
Figure 3
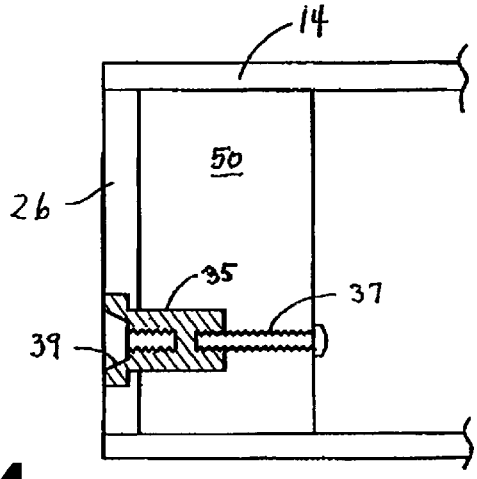
Figure 4

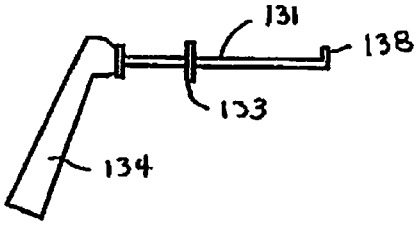
Figure 9
Figure 10
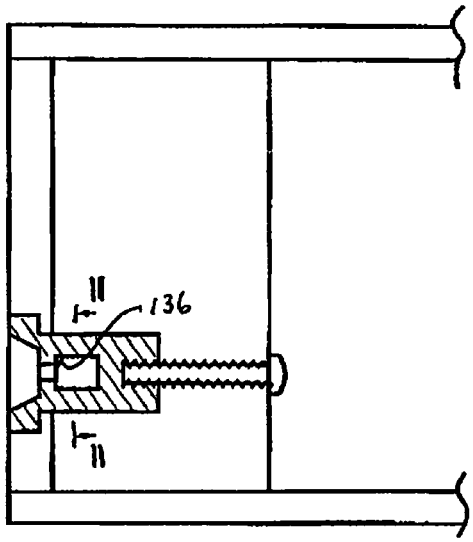

Figure 11
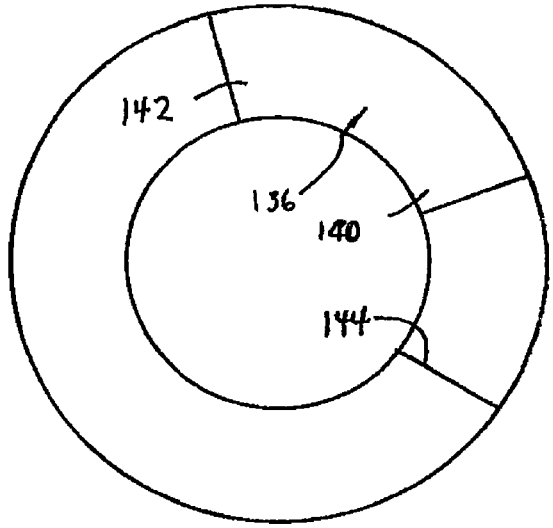
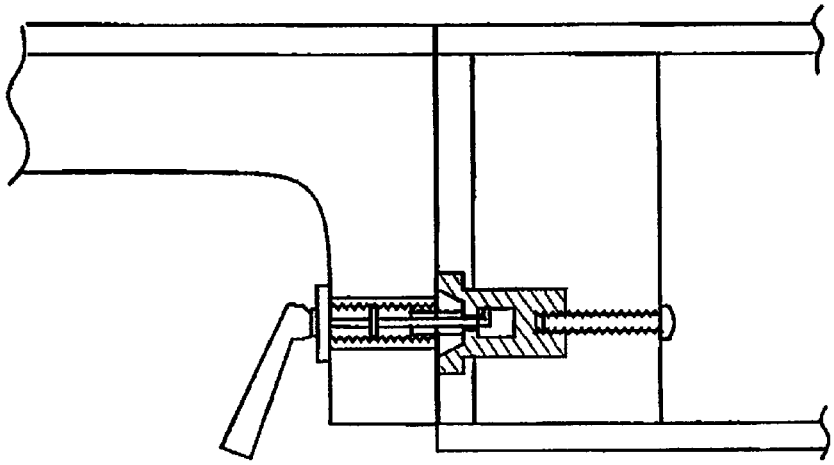
Figure 12

FOLDING GUITAR WITH SELF ALIGNING NECK

TECHNICAL FIELD

The invention relates to a folding guitar with a position locking mechanism.

BACKGROUND OF THE INVENTION

The manufacture of note producing musical instruments began as a search for the mechanical equivalent of the human voice. This in fact remained the standard through the Middle Ages and into the Renaissance and the early modern period.

Stringed instruments have been known since ancient times. These included such instruments as the lute, a guitar-like instrument with a sound box and fingerboard. A New Kingdom (ancient Egypt, 1380 BC) bronze in the collection of the Metropolitan Museum of Art depicts a dancing Nubian raised on his toes with one knee cocked, left hand high working a fingerboard and right hand plucking the strings in a pose which might be illustrative of a modern rock musician.

But the lute has a much more ancient history, perhaps originating with West Semitic nomadic people who brought the instrument to Mesopotamia, where the archaeological record includes representations dating back to the Akkadian period (2350 to 2170 B.C.), being introduced to the Egyptians, perhaps at the end of the Middle Kingdom Hyksos dynasties (XV to XVII dynasty, 1730 to 1580 B.C.).

In more recent times, stringed lute-like musical instruments continue to be among the most popular instruments. Folk artists throughout the United States have used the guitar, sometimes one of the homemade variety, in a wide range of musical genres including blues, bluegrass, and so forth.

In contrast to percussive instrumentation, the need for amplification of the relatively weak sounds of strings, reeds, and vibrating human lips presented challenges to early musical instrument manufacturers. These challenges were met primarily by resonant systems that mechanically concentrate, and output musical sound. There is a demanding standard in the stability of the instrument if high-quality sound is to be produced.

Moreover, over the years, artists playing acoustic stringed instruments have introduced a wide variety of playing techniques into the music surrounding these instruments. While, perhaps, the ancients only plucked the strings of the lute to achieve a musical tone which gradually decayed, later artists used the bow to produce notes of relatively constant and somewhat controllable amplitude. Modern artists employ a variety of techniques in their performances. Acoustic blues performers may rap their instruments with fingertips, palms or knuckles. Certain violin compositions, typically played by having a horsehair bundle slide across the strings, also call for the strings to be plucked. This results in yet greater demands being put on the mechanical stability of the instrument.

Given the popularity of stringed musical instruments, especially the guitar, people often take them along when traveling. However, they are bulky and poorly suited to convenient transport. They are unlikely to fit into airlines stowaway spaces or under airline seats. In response to this need, guitars with folding necks have been proposed. See for example my earlier United States Design Pat. No. 516,114, and my earlier pending U.S. patent application Ser. No. 11/640,095, filed Dec. 15, 2006. While this instrument is effective, it is difficult to make requiring significant handwork and fine tuning.

Accordingly, there is a need for a stringed instrument which may be a guitar, violin or the like and which is easy to use during a performance, consistent, and rigorous in its transduction of artistic interpretations into an acoustic or other performance and easily transportable. It is believed that the structure disclosed herein is a most effective solution in providing for a highly mobile instrument which may be accommodated to a range of user preferences.

This invention also relates to hinges and particularly what is commonly known as invisible hinges for the use in connection with doors and other swinging articles and the invention described here is an improvement on previous designs for the specific use where a very narrow surface is available for the hinge mechanism and the hinge must be able to support a proportionally much longer perpendicular surface. Also significant to this invention is the method used to locate and install the hinges.

In this type of hinge the hinge parts are connected by pivoted linkages hinged on a hinge pin and sliding on sliding pins, the linkages being within pockets or compartments within the hinge parts, that is the hinge plates or butt plates. An early version of such hinges is a hinge design created by Joseph Soss and bearing his name. It is illustrated in several patents including U.S. Pat. Nos. 1,030,936, 1,484,093, 1,688,996, 1,984,092, and 2,178,271 among others. A hinge of this sort is employed in the above referenced design patent.

These hinges are designed to be invisible when in the closed position and allow for the focal point of the hinge to be below the surface when in the closed position and then extend beyond the surface to allow for a full 180 degree opening. Two basic versions of the hinge are common, the first having a long narrow body with two attachment screws, one located at each end. This style is of a shape requiring a multi-level mortise cut for installation, the second is a cylinder or barrel hinge with a side mounted screw as a means of attachment and requiring a hole to be bored for installation.

These previous designs are of a similar nature but either lacks the clearance necessary, have methods of attachment that are either insufficient or impractical in a guitar with a folding neck and also require a complex process to create the openings for the hinge butt plates or cylinders.

Furthermore, while a version of the previous design has been proven capable of supporting this application to some extent in above United States Design Pat. No. D516,114, it has been found lacking in several areas with regard to effective production beyond the small, hand assembly shop.

First, these hinges, known as "barrel hinges," require a final outer surface, an example being a fretboard on musical instruments, to be attached out of sequence with normal production procedure and require holes to be bored extremely close to the surface of the fretboard weakening this vital structural member.

Second, these hinges are very difficult to set accurately with respect to depth and alignment. The other version of Soss hinge has better means of securement and greater location and depth control. However, its design only allows for a single hinge to fit in the required area which lacks the structural integrity for this application and lacks sufficient capability to adequately align the two hinged parts. Furthermore, the location of the securement screws is too close to the outer edges of the members, which in this application creates problems because of the lack of material for the screws to properly secure themselves. Currently available versions also lack the opening clearance needed for guitar hinge application. Finally, the means required to cut the mortises is very time consuming and difficult to consistently achieve.

In my copending patent application, U.S. patent application Ser. No. 11/640,095, I proposed an improved hinge for use in a folding guitar.

SUMMARY OF THE INVENTION

In accordance with the invention, the improved alignment provided by that improved hinge is still further improved by the self-aligning locking mechanism provided in accordance with the present invention. Such mechanism may be a screw or a bayonet type engagement.

In accordance with the invention, a self aligning folding guitar comprises a neck portion, and a body portion. The hinge it is mounted to the neck portion and the body portion. A first alignment member is secured to the neck portion. The second alignment member is secured to the body portion, the second alignment member meeting with the first alignment member at a substantially fixed position. A securement member secures the first alignment member to the second alignment member.

The first alignment member may include a conical surface.

The first and second alignment members may define surfaces which fit to each other.

The securement member is a threaded member.

The securement member may be a bolt or a bayonet.

Advantageously, the first alignment member may define an elongated bore for receiving the securement member.

The first alignment member may comprise a pipe like member with an internal thread and a frustroconical stud which screws into the pipe like member.

The second alignment member may comprise a solid body with a receiving volume which mates with the frustroconical stud, and further defines a threaded bore for receiving the securement member.

BRIEF DESCRIPTION THE DRAWINGS

The operation of the invention will become apparent from the following description taken in conjunction with the drawings, in which:

FIG. 1 is schematic side view illustrating the male member of the self-aligning mechanism of the present invention;

FIG. 2 is a plan view of the bolt-receiving hole in the member of FIG. 1;

FIG. 3 illustrates the locking screw used in accordance with the present invention;

FIG. 4 illustrates the female member of the self-aligning mechanism of the present invention;

FIG. 9 illustrates an alternative locking member;

FIG. 10 illustrates an alternative embodiment of a female member in accordance with the present invention for receiving the alternative locking member of FIG. 9;

FIG. 11 is a along lines 11-11 of FIG. 10;

FIG. 12 illustrates the alternative embodiment of the female member of the present invention in the locking position;

DETAILED DESCRIPTION OF THE PREFERRED EMBODIMENTS

Figure 5:
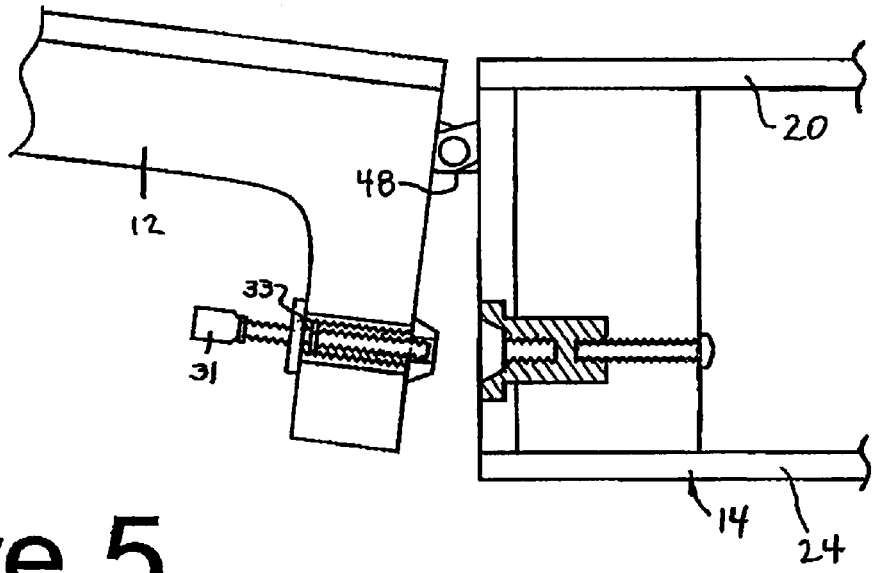
FIG. 5 illustrates the male and female members installed on a guitar or other string instrument in the open configuration.

Referring to FIG. 1, the neck 12 of a folding guitar is provided with a male alignment member 15. An alignment member 15 comprises a docking member 17 which screws into the threaded bore 19. Docking member 17 includes they had 21 and an integral threaded tubular member 23.

Alignment member 15 further comprises elongated tube 25 which includes a top flange 27. Flange 27 defines an elongated hole 29. Hole 29 receives a bolt 31 (FIG. 2) which includes a fictionally engaged retainer washer 33, as is described in detail below.

A mating female member 35, as illustrated in FIG. 4 is mounted in the body 14 of the guitar, passing through bout 26 support block 50. A bolt 37 passes through block that to mate with female member 35. Female member 35 includes a receiving cone 39, which receives and mates with head 21, to securely lock neck 12 with respect to body 14 of the guitar.

Figure 6:
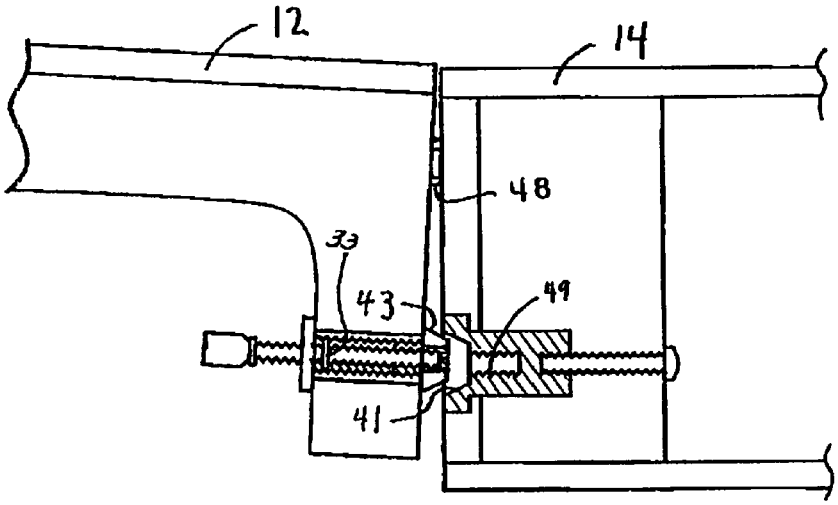
FIG. 6 is a side view similar to FIG. 5 illustrating the alignment operation.

As shown in FIG. 5, neck 12 is mounted to the body 14 of the guitar by a hinge 48. During use, neck 14 is pivoted toward body 12 from the position illustrated in FIG. 5 to the position illustrated in FIG. 6. Due to wear or normal tolerances in hinge 48, there may be some misalignment, as is illustrated in FIG. 6. Such misalignment is addressed by the engagement of surface 41 by surface 43 during the advancement of neck 12 from the position illustrated in FIG. 5 to the position illustrated in FIG. 6 and on to the position illustrated in FIG. 7.

Misalignment does not affect the ability to screw bolt 31 into bore 49 because elongated hole 29 allows proper alignment of bolt 31 with bore 49

Figure 7:
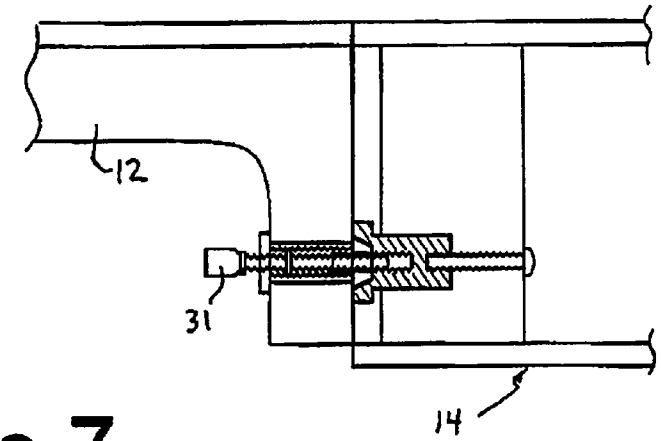
FIG. 7 is a side view similar to FIG. 6, showing the guitar neck in the playing position.
Figure 8:
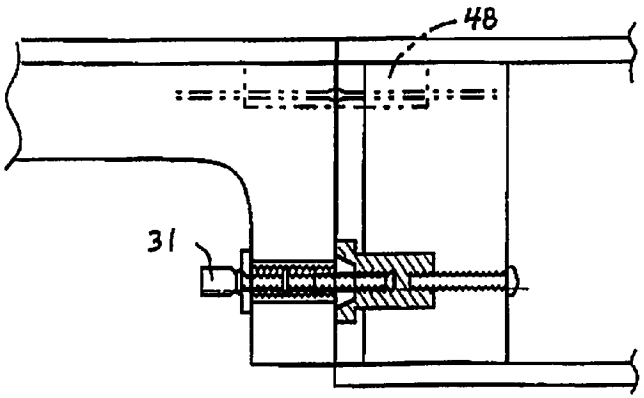
FIG. 8 is a view similar to FIG. 7 showing the guitar neck locked in the playing position.

Once the guitar has been put in the configuration illustrated in FIG. 7, both 31 may be tightened to take the position illustrated in FIG. 8.

Referring to FIG. 9, a bayonet 131 with a retainer washer 133 and an arm 134 may be used instead of bolt 31. As shown in FIG. 10, a ramp 136 is engaged by the arm 138 of bayonet 131. Ramp 136 as a shallow side 140 and a high side 142. During use arm 138 engages shallow side 140 after passing through notch 144, and is rotated to high side 142 to securely be locked in position, as illustrated in FIG. 12.

Figure 13:
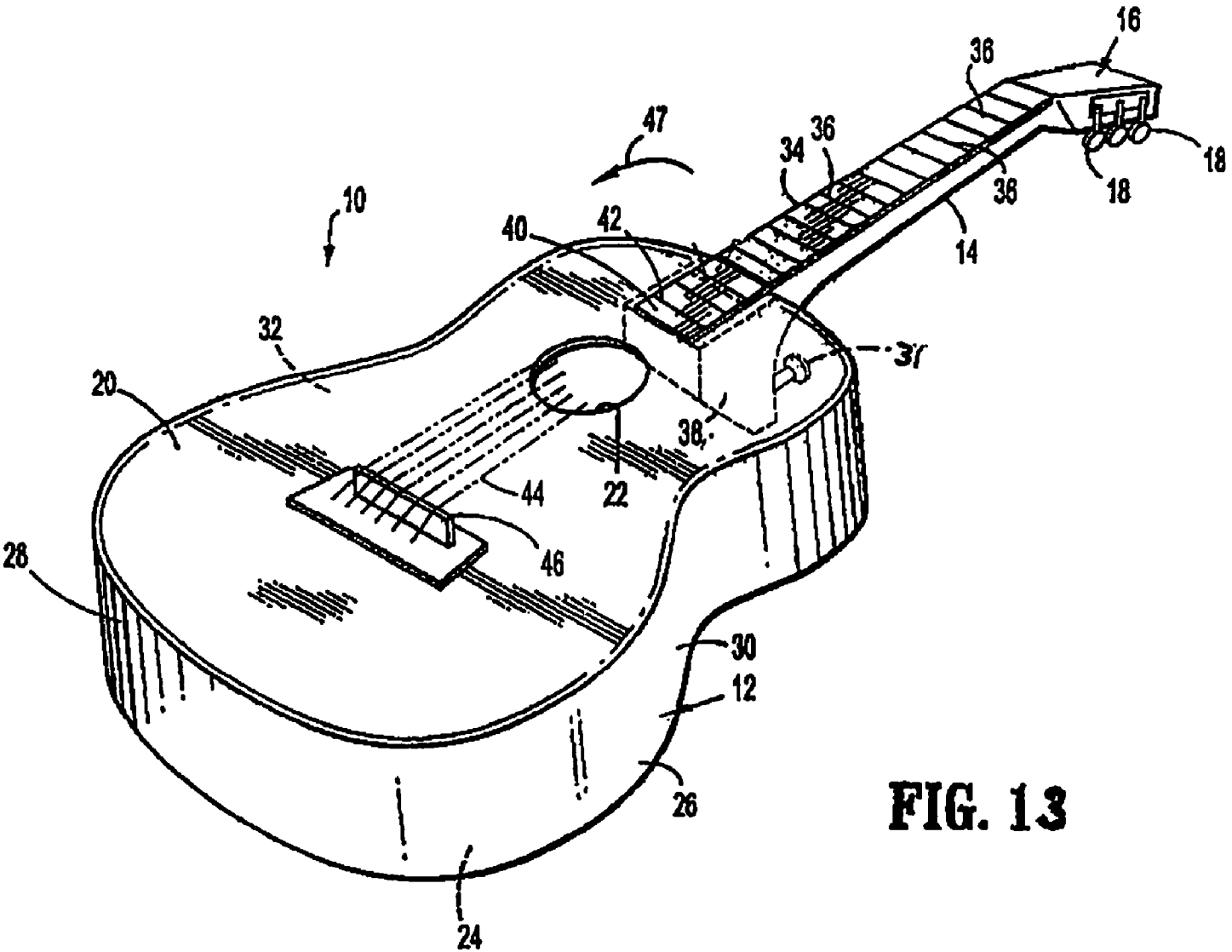
FIG. 13 illustrates the inventive locking mechanism installed in a guitar.

Referring to FIG. 13, a musical instrument constructed in accordance with the present invention is illustrated in which the self alignment structures of the present invention all our employed. While the invention may be employed in connection with acoustic or electrical guitars, violins, violas, bases, banjos or other stringed instruments, for purposes of illustration an acoustical guitar 10 is illustrated.

Generally, guitar 10 comprises a large hollow body 12, secured to the inventive neck 14. Neck 14 comprises a head 16, which accommodates tuning screws 18 in a conventional manner.

Body 12 comprises top plate 20 which defines a sound hole 22. Bottom plate 24 is secured to top plate 20 by bouts 26 and 28 which together form a guitar sound box sidewall having U-shaped upper and lower ends at the heel and tail ends of the body 12, and a curved central bout 30 and curved central bout 32 (not illustrated) which form the waist of the instrument.

Neck 14 supports a neck fretboard 34, which is glued to neck 14. Neck fretboard 34 supports a plurality of frets 36. Neck base 38 supports a neck base fretboard 40, which is glued to neck base 38. Neck base fretboard 40 supports a plurality of frets 42, against which strings 44 are played. For purposes of clarity of illustration, strings 44, which are supported by bridge 46 are illustrated partially and in phantom lines. Guitar neck 14 may be folded by rotation in the direction of arrow 47.

Figure 14:
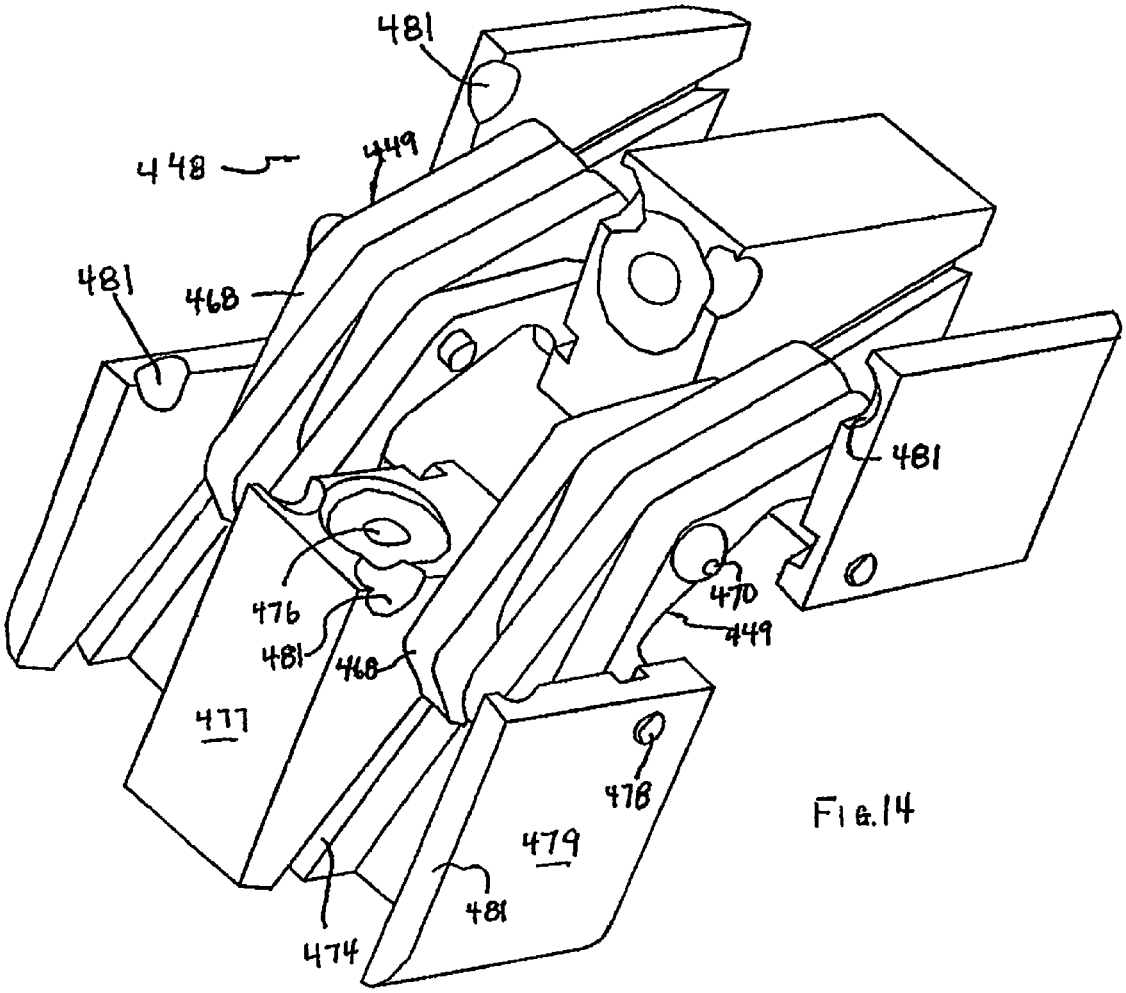
FIG. 14 is a perspective view of an improved hinge useful with the locking mechanism of the present invention.
Figure 15:
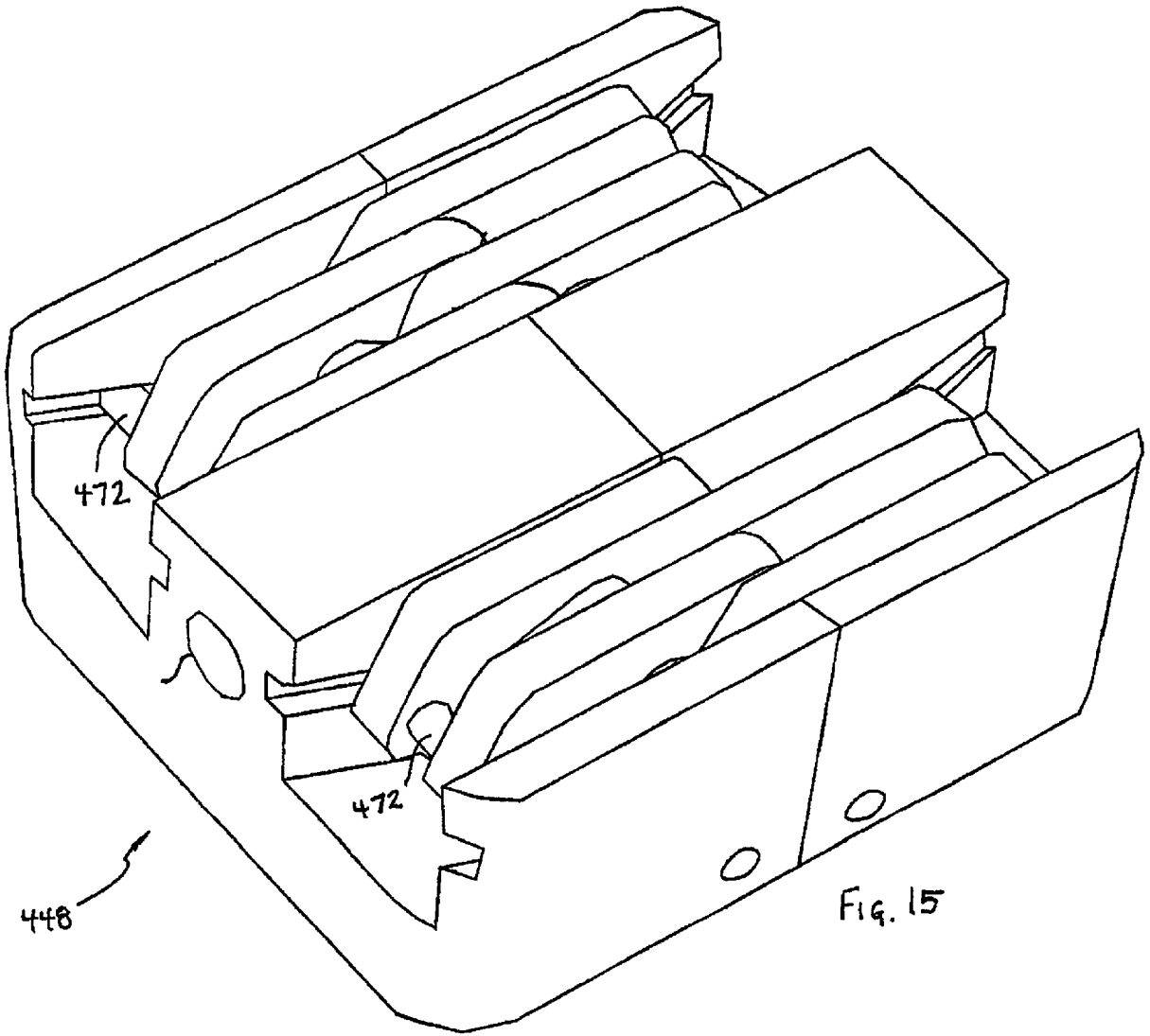
FIG. 15 is a perspective view of the hinge of FIG. 9 in the closed position from the bottom.
Figure 16:
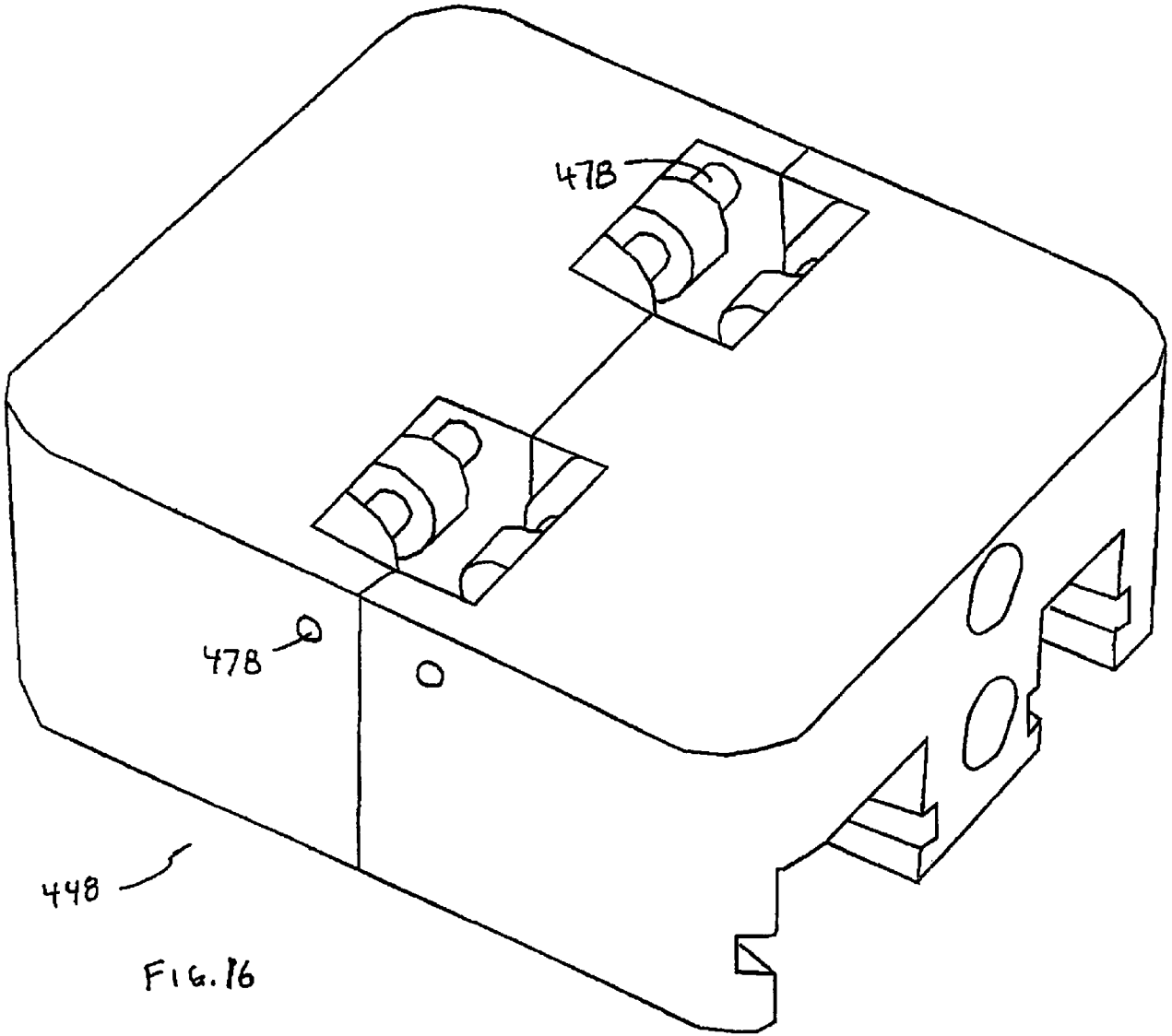
FIG. 16 is a perspective view of the hinge of FIG. 9 from the top.

A preferred embodiment of a hinge 448 for use with the self aligning mechanism of the present invention is illustrated in FIGS. 14-16. Hinge 448 comprises Soss link assemblies 449, which comprise hinge links 468, hinge pins 470, hinge pins 472 and pins 478. The operation of this hinge is similar to other Soss hinges. However, advantages are provided by the placement of screw hole 476, which because it is proximate side 477 of hinge 448 supports a screw which is driven into the, for example, neck at a point where there is sufficient wood on all of the sides of the screw to provide excellent support. At the same time, sidewalls 479 have a relatively small thickness 481 which promotes making available added thickness for Soss link assemblies 449. Slanted tracks 474 cooperate in providing the requisite configuration to allow use of the hinge in a guitar with a hinged neck.

In addition, compactness and strength is provided by thin receiving recesses 481, which allow the relatively large heads of robust pins 470 to be seated.

Figure 17:
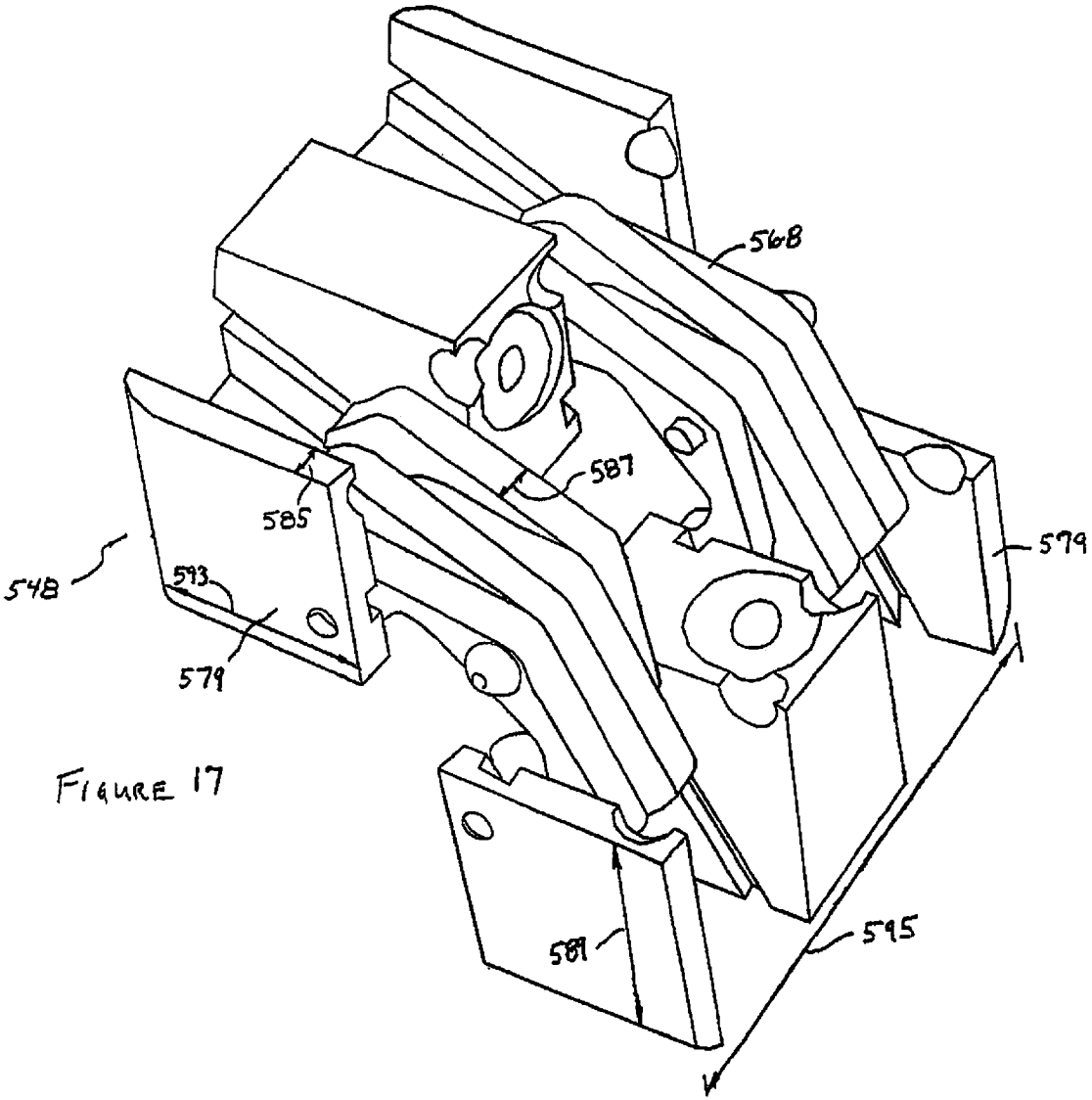
FIG. 17 is a view similar to FIG. 9 of another alternative hinge design.
Figure 18:
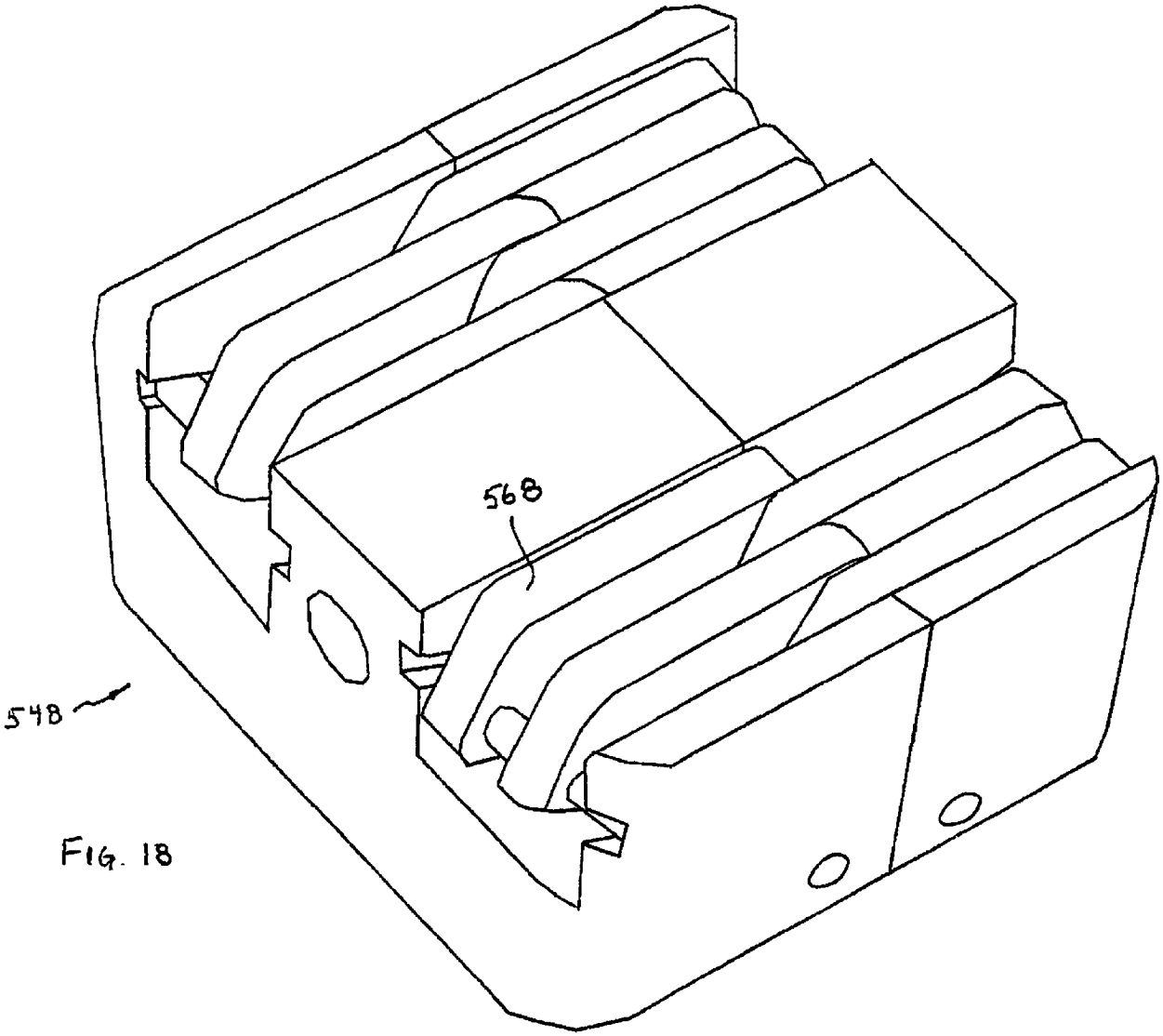
FIG. 18 is a view similar to FIG. 10 of the hinge illustrated in FIG. 12.
Figure 19:
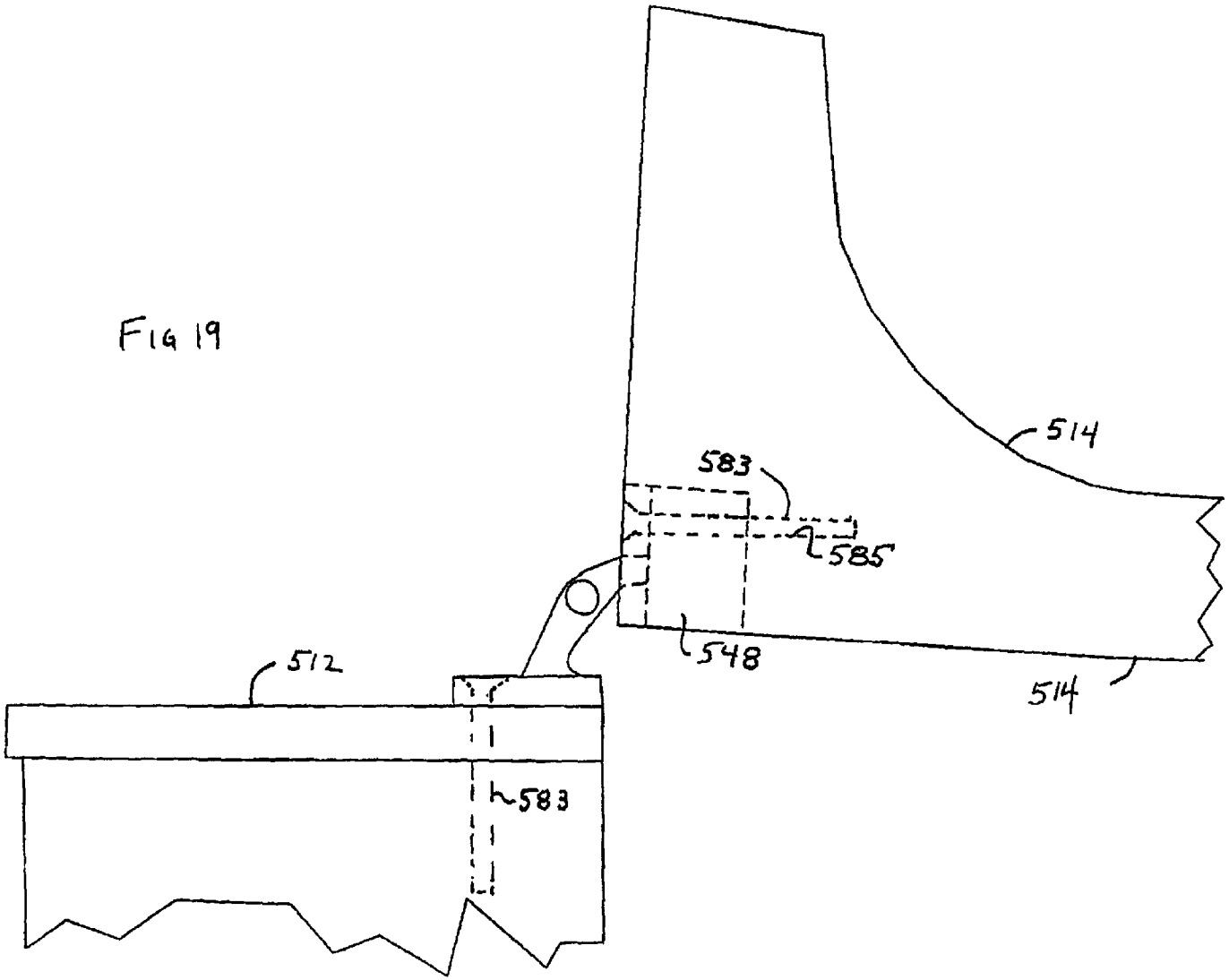
FIG. 19 illustrates the hinge of FIGS. 12 and 13 in use.

In accordance with a particularly preferred embodiment of the invention, it has been discovered that a short version of the hinge, as illustrated in FIGS. 17-18 is relatively advantageous. Hinge 548 is similar in construction otherwise to hinge 448. Part of the advantage of this construction may be seen from FIG. 19, where the shallower hinge butt results in a shorter lever arm acting through screw 583 to reduce the integrity of hole 585 in which screw 583 is seated, thus promoting the long-term stability of the guitar body 512 and guitar neck 514.

In accordance with a preferred embodiment, hinge 548 includes sidewalls 579 having a thickness 585 of approximately 0.25 cm. The thickness 587 of the links 568 is also 0.25 cm. The sidewalls 579 have a height 589 of 2 cm and a length 591 of 2 cm. Sidewalls 579 have a length 593 of 2 cm. Likewise, in accordance with a preferred embodiment, hinge 548 has a width 595 of 4 cm.

While illustrative embodiments of the invention have been described, it is, of course, understood that various modifications will be obvious to those of ordinary skill in the art. Such modifications are within the spirit and scope of the invention as illustrated and defined only by the appended claims.

What is claimed:

1. A self aligning folding guitar, comprising:

(a) a neck portion having a longitudinal axis;

(b) a body portion;

(c) a hinge mounted to said neck portion and said body portion;

(d) a first alignment member secured to said neck portion;

(e) a second alignment member secured to said body portion, said second alignment member mating with said first alignment member at a substantially fixed position, said first and second alignment members defining a tapered shape and a shape which mates with the tapered shape, so as to provide cooperating surfaces configured to contact each other at relative positions between said neck and body portions where said neck and body portions are not in hingedly moving alignment, and, as said neck and body portions are advanced toward each other, to guide said neck and body portions toward each other, whereby any misalignment in said hinge does not prevent said neck and body portions from being moved into properly aligned engagement with each other; and (f) a securement member for securing said first alignment member to said second alignment member, said securement member securing said first alignment member to said second alignment member by rotating about an axis extending in the direction of the longitudinal axis of the neck portion as said first alignment member is advanced toward and into contact with said second alignment member, wherein the rotation of the securement member being effective to cause the first alignment member to be drawn into mating contact with the second alignment member to lock said neck and body portions together.

2. A self aligning folding guitar as in claim 1, wherein said alignment members are coaxial with said securement member.

3. A self aligning folding guitar, comprising:

(a) a neck portion having a longitudinal axis;

(b) a body portion;

(c) a hinge mounted to said neck portion and said body portion;

(d) a first alignment member secured to said neck portion;

(e) a second alignment member secured to said body portion, said second alignment member mating with said first alignment member at a substantially fixed position, said first alignment member and said second alignment member being positioned further from a face of said guitar than said hinge, and said first alignment member and said second alignment member being anchored to said guitar neck and body portions independently from said hinge; and (f) a securement member extending in a direction parallel to the longitudinal axis of the neck portion, for advancing said first alignment member toward said second alignment member and for securing said first alignment member to said second alignment member, wherein said first alignment member comprises a pipe like member and a tapered portion which mates with and is guided into said second alignment member where said neck and body portions are not in hingedly moving alignment, said tapered portion being axially displaced from at least a portion of an internal thread, said tapered portion being tapered in directions which are roughly orthogonal to each other and perpendicular to an axis of movement of said tapered portions when said first alignment member is advance towards said second alignment member, wherein the securement member is effective to cause the first alignment member to be drawn into mating contact with the second alignment member to lock said neck and body portions together.

4. A self aligning folding guitar, comprising;

(a) a neck portion having a longitudinal axis;

(b) a body portion;

(c) a hinge mounted to said neck portion and said body portion;

(d) a first alignment member secured to said neck portion;

(e) a second alignment member secured to said body portion, said second alignment member mating with said first alignment member at a substantially fixed position; and (f) a securement member extending in a direction parallel to the longitudinal axis of the neck portion, for securing said first alignment member to said second alignment member, wherein one of said first or second alignment members comprises a pipe like member, wherein one of said first or second alignment members defines an internal thread and the securement member comprises a bolt which screws into said internal thread, and wherein one of said first or second alignment members defines a tapered shape and the other of said alignment members defines a shape which mates with said tapered shaped, one of said tapered shape or said shape which mates with said tapered shape is axially displaced from said internal thread, said tapered shape being configured and dimensioned to provide a guiding function substantially around its periphery, and engagement of said first alignment member to said second alignment member guides said neck portion to advance toward said body portion where said neck and body portions are not in hingedly moving alignment, and wherein said securement member screwed into said internal thread prevents disengagement between said first alignment member and said second alignment member thereby preventing said neck portion from pivoting away from said body portion, wherein the screwing of the securement member into said internal thread is effective to cause the first alignment member to be drawn into mating contact with the second alignment member to lock said neck and body portions together.

5. A guitar as in claim 4, wherein said first alignment member includes a conical surface.

6. A guitar as in claim 4, wherein said first and second alignment members define surfaces which are both conical and mate with each other.

7. A guitar as in claim 4, wherein said securement member is a threaded member.

8. A guitar as in claim 4, wherein said securement member is a bolt.

9. A guitar as in claim 4, wherein said securement member is a bayonet, said bayonet being effective for securing said first alignment member to said second alignment member.

10. A guitar as in claim 4, wherein said first alignment member defines an elongated bore for receiving said securement member.

11. A guitar as in claim 4, wherein said second alignment member comprises a solid body with a receiving volume which mates with a frustroconical portion, and further defines a threaded bore for receiving said securement member.

12. A self aligning folding guitar, comprising:

(a) a neck portion having a longitudinal axis;

(b) a body portion;

(c) a hinge mounted to said neck portion and said body portion;

(d) a first alignment member secured to said neck portion and defining an elongated bore;

(e) a second alignment member secured to said body portion, said second alignment member defining a threaded bore and mating with said first alignment member at a substantially fixed position, said first and second alignment members defining cooperating surfaces configured to contact each other at relative positions between said neck and body portions where said neck and body portions are locked together by the contact of the cooperating surfaces, and, as said neck and body portions are advanced toward each other, said cooperating surfaces being effective to guide said neck and body portions toward and into alignment with each other where said neck and body portions are not in hingedly moving alignment, whereby misalignment in said hinge does not prevent said neck and body portions from being moved into properly aligned engagement with each other; and (f) a threaded securement member extending in a direction parallel to the longitudinal axis of the neck portion, for passing co-axially through the elongated bore of the first alignment member and the threaded bore of the second alignment member and being screwed into the threaded bore of the second alignment member for securing said first alignment member to said second alignment member, wherein said first and second alignment members define said cooperating surfaces configured and dimensioned as mating conical surfaces, said conical surfaces being drawn into engagement with each other by the securement member so that they are effective for locking together said neck and said body portions.

13. A guitar as in claim 12, wherein said securement member is a bolt.

* * * * *